United States Patent [19]

Lizzi et al.

[11] Patent Number: 5,030,941

[45] Date of Patent: Jul. 9, 1991

[54] ELECTRONIC ARTICLE SURVEILLANCE SYSTEM INCORPORATING AN AUXILIARY SENSOR

[75] Inventors: Phillip Lizzi, Deptford, N.J.; Richard Shandelman, Levittown, Pa.

[73] Assignee: Checkpoint Systems, Inc., Thorofare, N.J.

[21] Appl. No.: 457,372

[22] Filed: Dec. 27, 1989

[51] Int. Cl.[5] ..... G08B 13/14

[52] U.S. Cl. ..... 340/572; 340/522; 340/541

[58] Field of Search ..... 340/572, 522, 573, 567, 340/555, 554, 666, 541; 367/93-94

[56] References Cited

U.S. PATENT DOCUMENTS

| | | | |
|---|---|---|---|
| 4,682,155 | 7/1987 | Shirley | 340/573 |
| 4,684,933 | 8/1987 | Dill | 340/572 |
| 4,818,973 | 4/1989 | Yamakawa et al. | 340/572 |
| 4,831,363 | 5/1989 | Wolf | 340/572 |
| 4,881,061 | 11/1989 | Chambers | 340/572 X |

*Primary Examiner*—Glen R. Swann III
*Assistant Examiner*—Thomas J. Mullen, Jr.
*Attorney, Agent, or Firm*—Weiser & Stapler

[57] ABSTRACT

To reduce the occurrence of false alarms, the disclosed system incorporates an auxiliary sensor for detecting the presence of a shopper passing through the electronic article surveillance device, such that the device is operated continuously, and the auxiliary sensor is used to enable external alarms of the device only upon detecting the shopper's presence. Thus, while the device continuously monitors field-induced signals which are received, activation of the external alarm is permitted only when a shopper passes through the security device and is detected by the auxiliary sensor. Sounding of the alarm is then based upon an analysis of the data received at and just prior to the detected approach of the shopper to be monitored, eliminating phantom alarms while significantly reducing false alarms and merchandise-activated alarms.

29 Claims, 4 Drawing Sheets

DETERMINE SENSOR TYPE
45
46
PASSIVE SENSOR
YES
NO
47
TAKE MEASUREMENT
48
DERIVE VELOCITY
49
POSITION SENSITIVE SENSOR
YES
NO
50
SAMPLE POSITION AND COMPUTE VELOCITY
51
VELOCITY DETECTING SENSOR
YES
NO
52
MEASURE OUTPUT
53
MORE THAN ONE SENSOR USED?
YES
NO
54
COMBINE MEASUREMENTS
MODIFY PARAMETERS
55
GO TO 10 (FIG. 2)

ELECTRONIC ARTICLE SURVEILLANCE SYSTEM INCORPORATING AN AUXILIARY SENSOR

BACKGROUND OF THE INVENTION

The present invention relates generally to so-called "electronic article surveillance", and in particular, to a system which involves the use of electronically detectable tags or labels which are attached to articles of merchandise in order to protect these articles from unauthorized removal, such as by shoplifting.

For enhanced security and inventory control, the use of electronic article surveillance (EAS) systems has become increasingly widespread. These systems utilize tags or labels which contain an electronic circuit (e.g., a resonant circuit) for interacting with an applied (e.g., swept radio-frequency) electromagnetic field. A transmitter and accompanying antenna produce this field, and a nearby receiver and accompanying antenna detect variations in the received field caused by the presence of a tag. This transmitting and receiving equipment is positioned at the location or locations where it is desired to detect the unauthorized removal of tag-bearing articles, e.g., at the exit of a retail store.

An important consideration in connection with the use of such EAS systems is to minimize the occurrence of false alarms which could either cause embarrassment to customers of the retail store, or produce annoying alarm signals when no one is passing through the store's EAS system. To this end, consideration must be given to what are essentially three different types of false alarm signals, as follows.

For example, an alarm (generally referred to as a "false" alarm) can at times occur when a shopper passes through the EAS system, without possessing any tag-bearing (i.e., protected) merchandise, but an alarm is nevertheless sounded. Yet another, more specific type of false alarm signal is the so-called "merchandise" alarm, which occurs when a shopper carries non-protected merchandise through the EAS system which nevertheless exhibits the characteristics of an active tag or label. Examples of this are items such as extension cords and cables, foldable chairs, and other coiled metal objects which are capable of resonance in the presence of the electromagnetic field of an EAS system. Yet another, more specific type of false alarm signal is the so-called "phantom" alarm, which occurs when an EAS system sounds an alarm responsive to the detection of an "ambient" signal, generally when there is no one passing through the EAS system. Examples of this are false alarm signals produced by tag bearing merchandise placed on display near enough to the EAS system to accidently cause its activation.

Various measures have been taken to reduce false alarms, to the extent possible. One approach which has been attempted in an effort to reduce the occurrence of phantom alarms is to operate the EAS system responsive to an auxiliary sensor which can detect when a shopper is passing through the EAS system. This can be accomplished using any of a variety of available proximity sensors including photoelectric sensors, body heat sensors, floor switches and the like. An example of an EAS system which presently makes use of an auxiliary sensor of this general type is the "Quicksilver" System available from Checkpoint Systems, Inc. of Thorofare, N.J.

In operation, the auxiliary sensor which is provided is used to initiate (activate) operation of the associated EAS system. Thus, it is only upon detecting the presence of a shopper exiting the retail store that the auxiliary sensor will cause activation of the EAS system, so that phantom alarms are effectively eliminated.

However, EAS systems which employ auxiliary sensors of this type do not serve to eliminate false alarms, or merchandise alarms. This is because, once activated (upon detecting the presence of a shopper), the associated EAS system is then operated in entirely conventional fashion to detect the presence of active tags or labels affixed to merchandise being carried by the person passing through the EAS system. Thus, while eliminating the annoyance of phantom alarms, such systems do not eliminate the significant embarrassment of a false alarm or a merchandise-activated alarm. Rather, the EAS system will still be able to produce such false alarm signals. Larger (generally coiled) merchandise will still be able to produce merchandise alarms. Tags or labels attached to merchandise located near the EAS system will still be able to produce false alarms. What is more, the true cause of such false alarm signals then tends to be cloaked by the intermittent operation of the EAS system, which is then activated only when a shopper is present.

Yet another disadvantage which can present itself is that because the EAS system is activated only responsive to the presence of a shopper, care must be taken to provide the EAS system with sufficient time to detect an active tag or label (i.e., a complete acquisition cycle must occur). Depending upon the manner in which the tag or label is oriented with respect to the EAS system, and the speed at which the tag or label is being carried through the EAS system, the potential exists for protected merchandise to be missed by the EAS system. In essence, the protected merchandise is permitted to pass through the EAS system before the EAS system has had sufficient time to respond to the associated tag or label.

As a result of the foregoing, EAS systems which are activated responsive to auxiliary sensors have enjoyed only sporadic use. It therefore became desirable to improve upon such systems to enhance their reliability, and accordingly, their attractiveness to retail stores.

SUMMARY OF THE INVENTION

The primary purpose of the present invention is to provide an improved means for activating an electronic article surveillance (EAS) system using an auxiliary (proximity) sensor.

It is also an object of the present invention to provide an EAS system which is responsive to an auxiliary (proximity) sensor and which can effectively prevent phantom alarms, while significantly contributing to the reduction of false alarms and/or merchandise-activated alarms.

It is also an object of the present invention to provide a means for activating an EAS system responsive to an auxiliary (proximity) sensor which is readily adaptable to existing EAS systems.

These and other objects are achieved in accordance with the present invention by providing an EAS system which incorporates an auxiliary sensor for detecting the presence of a shopper, and which is operated in accordance with a novel information processing technique. Specifically, rather than using the auxiliary sensor to activate a dormant EAS system upon detecting the presence of a shopper, the EAS system of the present invention is operated continuously, and the auxiliary sensor is used to enable (and disable) the external alarm of the EAS system only upon detecting the presence of a shopper.

The EAS system of the present invention therefore has the advantage of being able to continuously monitor field-induced signals received by the EAS system, for analysis within the system's processor even while the system remains dormant. Internal EAS system functions are accordingly maintained, and potential alarm conditions are noted internally. However, an external alarm is permitted only when a shopper passes through the EAS system, and is detected by the auxiliary sensor. Only then is the external alarm of the system enabled, so that an alarm can be sounded based upon an analysis of the data received at and just before the detected approach of the shopper to be monitored. Through this analysis, a positive determination can be made as to whether or not a series of signals represent an actual attempt to remove protected merchandise from the retail store, or whether the series of signals result from some other source (i.e., a false alarm or a merchandise-activated alarm).

For further detail regarding an EAS system produced in accordance with the present invention, reference is made to the detailed description which is provided below, taken in conjunction with the following illustrations.

Brief Description of the Drawings

In the several views provided, like reference numbers denote similar structure.

DETAILED DESCRIPTION OF PREFERRED EMBODIMENTS

Figure 1:
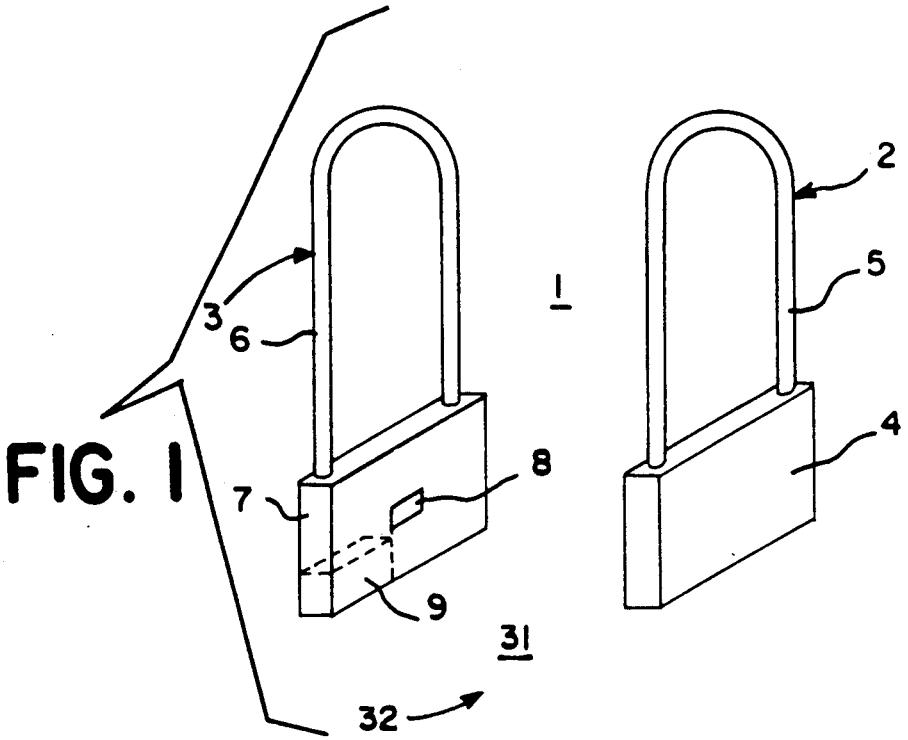
FIG. 1 is an isometric view which illustrates the basic components of the EAS system of the present invention.

FIG. 1 illustrates the basic components of an electronic article surveillance system 1 (EAS system), which is generally comprised of a pair of screens 2, 3 positioned in parallel and at a spaced distance from one another. The screen 2 incorporates a transmitter 4 and a transmitting antenna 5 for producing the swept radio frequency fields which are traditionally used in conjunction with such systems to detect the presence of a tag or label (not shown) affixed to merchandise to be protected. The remaining screen 3 incorporates a receiving antenna 6 and a receiver 7 which then operate to detect a disturbance (resulting from the presence of an active tag or label) in the radio frequency fields produced by the screen 2, which is then used to sound an appropriate alarm. For further detail regarding a system of this general type, reference is made to copending U.S. patent application Ser. No. 07/295,064, filed Jan. 9, 1989 and entitled "Electronic Article Surveillance System With Improved Differentiation", the subject matter of which is incorporated by reference as if fully set forth herein. As previously indicated, EAS systems of this general type are available from manufacturers such as Checkpoint Systems, Inc. of Thorofare, N.J., among others.

Previously, one of the screens, preferably the screen 3 which incorporates the receiver 7, would have been provided with an auxiliary sensor 8 capable of detecting the presence of someone between the screens 2, 3 of the EAS system 1. A variety of sensors were used for this purpose, including photoelectric sensors, body heat sensors, and even floor switches (floor mats), as desired. In any event, the auxiliary sensor 8 was then electrically connected to the receiver 7 of the EAS system 1 so that the EAS system 1 was enabled (activated) only when a shopper passed between the screens 2, 3. Systems of this general type are presently commercially available, an example being the "Quicksilver" System manufactured by Checkpoint Systems, Inc.

Figure 2:
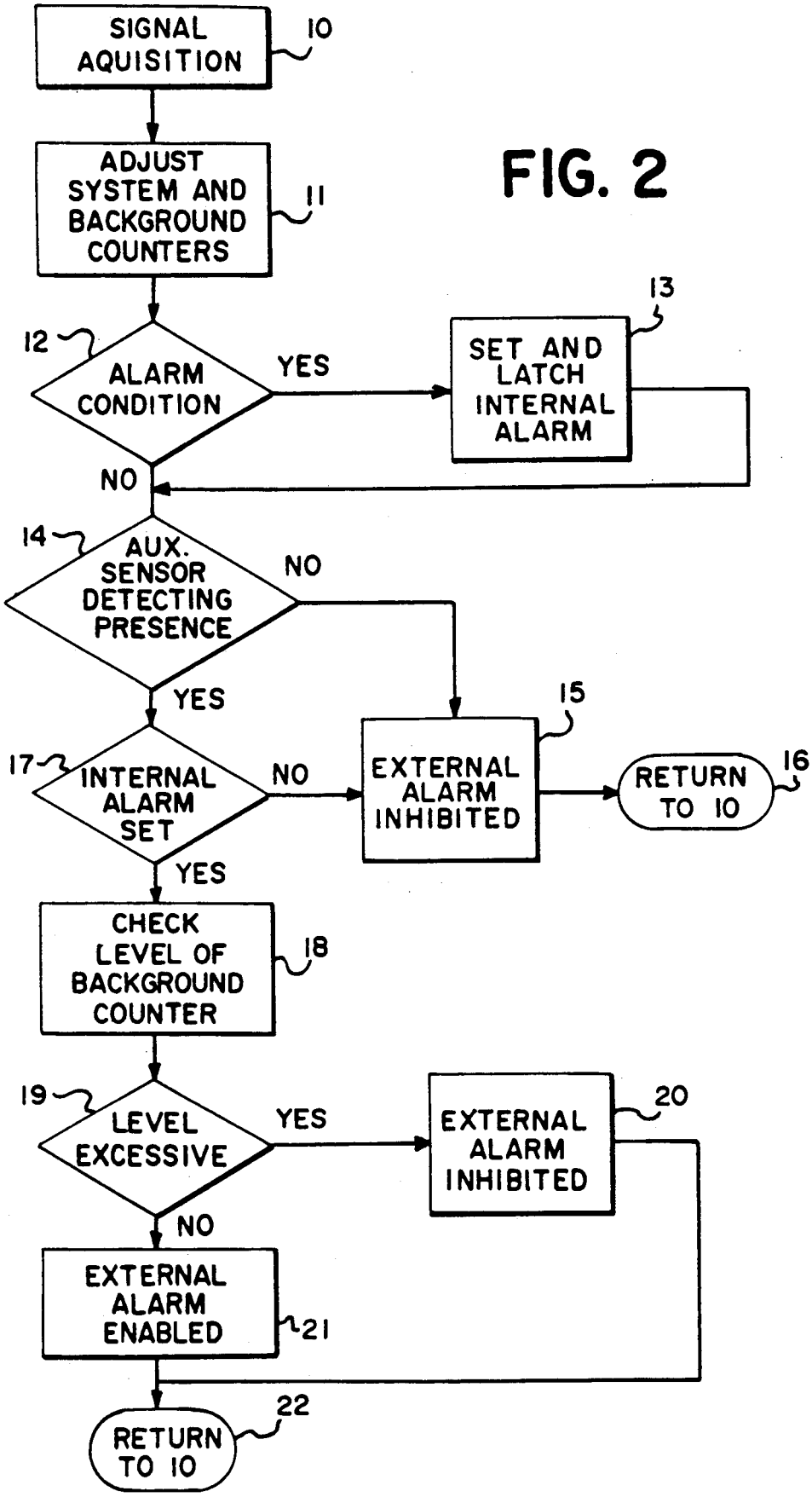
FIG. 2 is a flow chart which illustrates operations within the processor of the EAS system of FIG. 1.

The processing of information developed by the screens 2, 3 of the EAS system 1, as well as interaction with the auxiliary sensor 8, is accomplished within a processor 9 associated with the EAS system 1 (generally within the receiver 7). The processor 9 was previously used to analyze signals detected by the receiver 7 (to detect the presence of a tag or label between the screens 2, 3 of the EAS system 1) only upon activation responsive to signals received from the auxiliary sensor 8. However, in accordance with the present invention, operations within the processor 9 are modified so that the EAS system 1 will operate to continuously monitor received signals, but so that the EAS system 1 will only be able to provide an alarm (signifying an unauthorized removal of merchandise) when the auxiliary sensor 8 detects the presence of a person between the screens 2, 3. Thus, the EAS system 1 is caused to operate in what is essentially a "background" mode, to gather data even when the alarm of the EAS system 1 is disabled by the auxiliary sensor 8. As a result, when the auxiliary sensor 8 detects the presence of a shopper between the screens 2, 3, and the alarm of the EAS system 1 is enabled, a "history" of received signals is made available for analysis to effectively discriminate between a valid alarm condition and a false or merchandise-activated alarm. FIG. 2 is a flow chart which shows those modifications made to the processor of the EAS system 1 to operate in accordance with the present invention, as follows.

As previously indicated, a key advantage of the EAS system 1 of the present invention is that it operates to continuously process data for making a determination as to whether or not an active tag or label is present between the screens 2, 3 of the EAS system 1 upon activation responsive to the auxiliary sensor 8. To this end, the system incorporates means for continuously acquiring signals (represented in FIG. 2 at 10), and means for continuously processing these received signals (represented in FIG. 2 at 11) by adjusting counters associated with the processor of the EAS system as is more fully described in the above referenced U.S. patent application Ser. No. 07/295,064. Acquired information is then processed in accordance with the present invention, as follows.

Essentially, what is established is an information gathering loop which operates to continuously acquire data, irrespective of the condition of the auxiliary sensor 8. Broadly speaking, this is accomplished by first acquiring information, at 10, and then adjustinq the counters 11 of the processor 9. A test of the system's counters is then made, at 12, to determine whether or not an alarm condition is present. If so, the EAS system 1 is internally set (and latched to allow for subsequent operations to proceed) to report an alarm condition, at 13, but does not yet externally do so. Rather, the auxiliary sensor 8 is first checked, at 14, to determine whether or not someone is present between the screens 2, 3 of the EAS system 1. If not, the system's external alarm is inhibited, at 15, thereby avoiding a false (phantom) alarm. The information gathering loop is then completed at 16, whereupon a subsequent processing sequence is then commenced with an acquisition of updated information, at 10, as previously described.

In the event that the test at 14 determines that someone is present between the screens 2, 3 of the EAS system 1, steps are then taken, at 17, to determine the condition of the internal alarm 13. Since, as previously described, the internal alarm 13 will have been set (and latched to this point) responsive to the test performed at 12, the resulting positive test (at 17) will then operate to cause a background counter to be checked, at 18.

One problem which was often faced by previously available EAS systems with auxiliary (people detecting) sensors was phantom alarms emanating from tags or labels attached to merchandise located near the EAS system 1. In such cases, when a person was detected between the screens 2, 3 of the EAS system 1, the EAS system 1 would automatically become activated by the "ambient" signals produced by the adjacent merchandise, providing a false alarm. What is more, since this only occurred following the presence of someone between the screens 2, 3 of the EAS system 1, the cause of such false alarms became quite difficult to determine. The background counter at 18 is provided to eliminate this drawback, as follows.

As previously indicated, the EAS system 1 of the present invention continuously operates to process received information even though the external alarm remains inhibited. Thus, the presence of tags or labels near the EAS system 1 will rapidly cause the count maintained within the counter 18 (incremented at 11) to become excessive. A test can then be made of the background counter 18, at 19, to determine its condition (upon the detection of an alarm condition) prior to sounding the external alarm. If this count is found to be excessive, the external alarm is inhibited, at 20, to avoid the unwanted false alarm. However, it is important to note here that this internal condition (the test 19) can be used to report that there is a disturbance in the vicinity of the EAS system 1, permitting this disturbance to be rectified without first suffering a series of false alarms.

In the event that the background counter 18 is found not to be excessive, the external alarm is enabled, at 21. Steps are then taken to exit the routine, at 22, and to then acquire updated information at 10, for processing as previously described. The auxiliary sensor 8 is preferably latched during this period, to ensure that a detected presence is maintained during subsequent data acquisitions. Should a count (of a system counter at 11) then be reached which signifies a detected tag or label in accordance with prior techniques, an actual alarm can then be sounded by the enabled external alarm of the EAS system 1.

Figure 3:
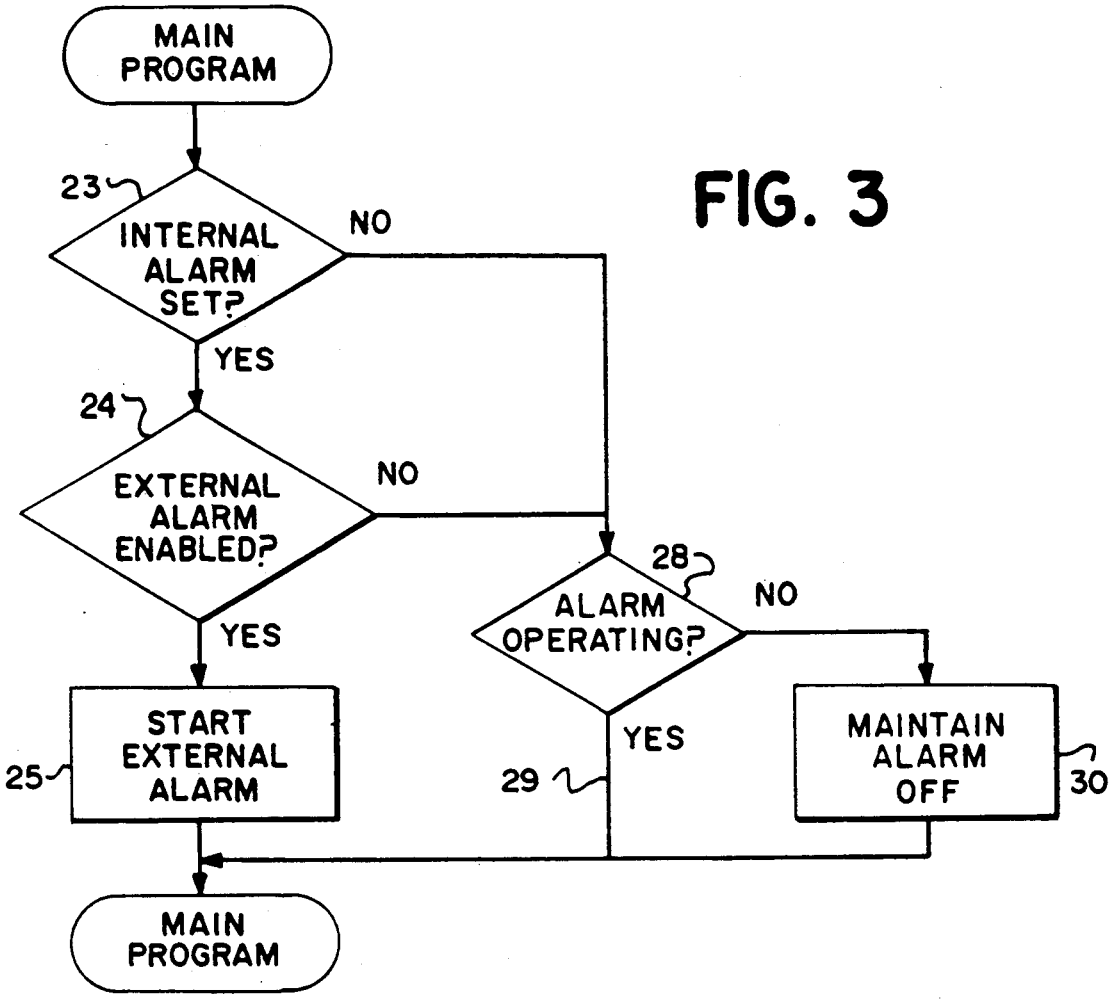
FIGS. 3 and 4 are flow charts which illustrate cooperation between the series of operations illustrated in FIG. 2, and the basic operations of the associated EAS system.
Figure 4:
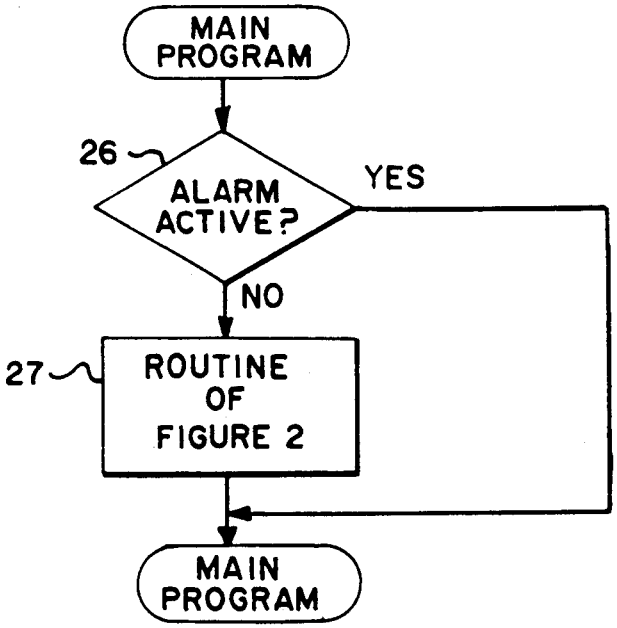

FIGS. 3 and 4 illustrate the manner in which the EAS system 1 then operates to sound an actual alarm, as follows. In operation, the previously described steps are performed as what is essentially a background routine forming part of the overall operations of the processor 9 of the EAS system 1. As part of its overall function, the processor 9 takes steps to periodically check the status of this background monitoring, as illustrated in FIG. 3. To this end, the main program routine which is conventionally performed by the processor 9 (e.g., in accordance with the above-referenced U.S. patent application Ser. No. 07/295,064) takes steps to determine, at 23, whether the internal alarm has been set (at 13). If so, steps are then taken to determine, at 24, whether the external alarm has been enabled (at 21). In such case, the external alarm of the EAS system 1 is then sounded, at 25. As shown in FIG. 4, upon activation of the external alarm, at 25, steps are also taken to bypass the routine of FIG. 2 (shown collectively at 27) responsive to a test performed at 26. This continues for a specified period of time deemed sufficient to alert personnel of the retail store of the attempted removal of protected merchandise.

In the event that either the internal alarm has not been set (test 23), or the external alarm has not been enabled (test 24), steps are then taken to determine whether the abovedescribed alarm cycle (at 25) has already been initiated, at 28. If so, the initiated alarm is continued, at 29. If not, the external alarm is maintained in an off state, at 30. This then operates to fully incorporate the routine of FIG. 2 into the remainder of an otherwise conventionally operating EAS system 1, in accordance with the present invention.

Let it now be assumed that the test performed at 12 had determined that an alarm condition is not present. This will then cause the condition of the auxiliary sensor 8 to be checked, at 14, to determine its condition. If there is no presence detected between the screens 2, 3 of the EAS system 1, the external alarm is inhibited, at 15, and the information gathering routine is terminated, at 16 (followed by an acquisition of updated information, at 10). If a presence is detected between the screens 2, 3, a test will be made at 17 to determine whether or not the internal alarm has been set. Since this test will be negative, steps will then be taken to inhibit the external alarm, at 15, and to exit the routine, at 16, for a subsequent acquisition of updated information at 10, as previously described.

Thus, it is seen that an important benefit of the technique of the present invention is the ability to analyze background signals at times when the auxiliary sensor 8 is deactivated. Detecting the presence of tags or labels between the screens 2, 3 of the EAS system 1 is accomplished in what is essentially conventional fashion. As with previous systems of this general type, an external alarm is only sounded when there is a presence between the screens 2, 3 of the EAS system 1, avoiding phantom alarms. However, the counter 18 additionally makes it possible for the EAS system 1 to inhibit phantom alarms resulting from tags or labels placed near the EAS system, avoiding a potential source of false alarms which had previously been unaccounted for. Rather, in accordance with the present invention, the external alarm of the EAS system 1 is inhibited (avoiding embarrassment), and an internal flag is made available to advise the retail store of the phantom signals which are being produced by the protected merchandise positioned near the EAS system 1.

Yet another benefit of the EAS system 1 of the present invention is its ability to reduce merchandise-activated alarms, as follows. With reference to FIG. 1 of the drawings, conventional EAS systems will operate to detect tags or labels when present between the screens 2, 3, in the region 31. However, it has been found that merchandise-activated alarms will tend to be detected much sooner, for example, when the merchandise in question is still approaching the screens 2, 3 of the EAS system 1, in the region 32. This difference can be detected either through an excessive count within the counter 18, or when a valid alarm condition is detected by the EAS system 1 just prior to the detection of a presence between the screens 2, 3 of the EAS system 1 by the auxiliary sensor 8. In either case, steps can then be taken to inhibit the system's external alarm, avoiding the false, merchandise-activated alarm.

It will therefore be seen that the EAS system of the present invention operates to satisfy the various objectives previously stated, and to provide a reliable indication of alarms while significantly reducing the potential for false, phantom, and even merchandise-activated alarms. However, it will be understood that the system of the present invention is further capable of variation, to meet desired application requirements. For example, it is possible to adjust the sensitivity of the system by adjusting the sensitivity of the various signal-detecting elements previously described, and/or by increasing or decreasing the counts selected for the system counters, at 11. Other variations will occur to the person of ordinary skill in the art.

Yet another possible variation which warrants separate consideration is as follows. The EAS system 1 previously described makes a relatively straight-forward determination as to whether or not there is a presence between the screens 2, 3, and to then enable or disable the system accordingly. However, it is also possible to make use of more elaborate routines to obtain still further information regarding tags or labels which may come to pass in the vicinity of the EAS system 1.

Figure 5:
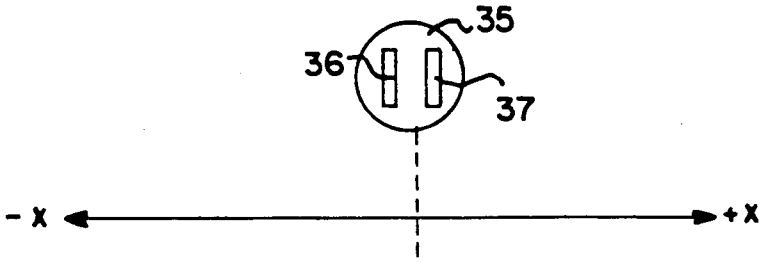
FIGS. 5 and 6A–6C are schematic illustrations of a technique for detecting movement relevant to the EAS system of the present invention.
Figure 6A:
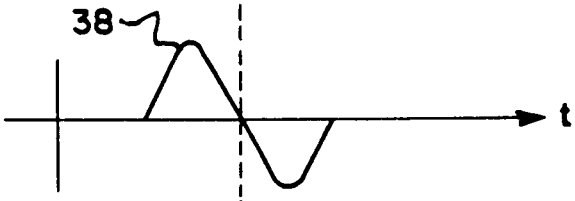
Figure 6B:
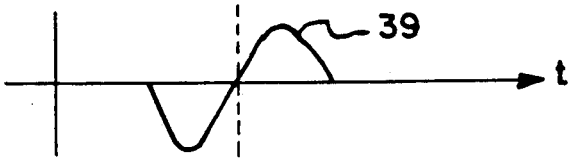
Figure 6C:
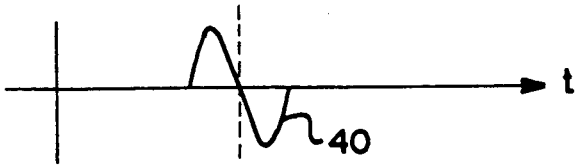

FIGS. 5 and 6 illustrate a basic example of this, making use of a heat sensor 35 to provide the function of the auxiliary sensor 8. Conventionally available heat sensors 35 incorporate a pair of elements 36, 37 which cooperate to develop a differential signal which corresponds to the difference in level detected at the element 36, 37, respectively. As a result of this, and referring now to FIG. 6*a*, this is reflected in a time varying output which corresponds to the curve 38. Detected movement in the opposite direction will result in the output 39 shown in FIG. 6*b*, which essentially constitutes the mirror image of the curve 38.

Thus, the polarity of the detected signal 38, 39 may be used to determine whether a person is approaching or departing from the screens 2, 3 of the EAS system 1, which can be used to further enhance the information history which is developed for analysis by the EAS system 1 as previously described. This is particularly useful in testing for merchandise-activated alarms.

Further to be noted is that as the speed of a person approaching (or departing from) the screens 2, 3 varies, so too will the period of the detected signal. This is best illustrated with reference to FIG. 6*c*, and the shorter period which the curve 40 exhibits, which is indicative of a speed of approach greater than the speed of approach represented by the curve 38. This information can again be used to analyze the approach (or departure) of a potential target, as previously described, to further enhance the reliability of the EAS system 1.

Yet another variation which warrants separate consideration is that different, and indeed more elaborate sensor types may be used to determine the position of a person relative to the EAS system 1, providing still further information for processing as previously described. This could include the use of commercially available sensors such as ultrasonic detectors, microwave detectors and infrared detectors, as desired.

Figure 7:
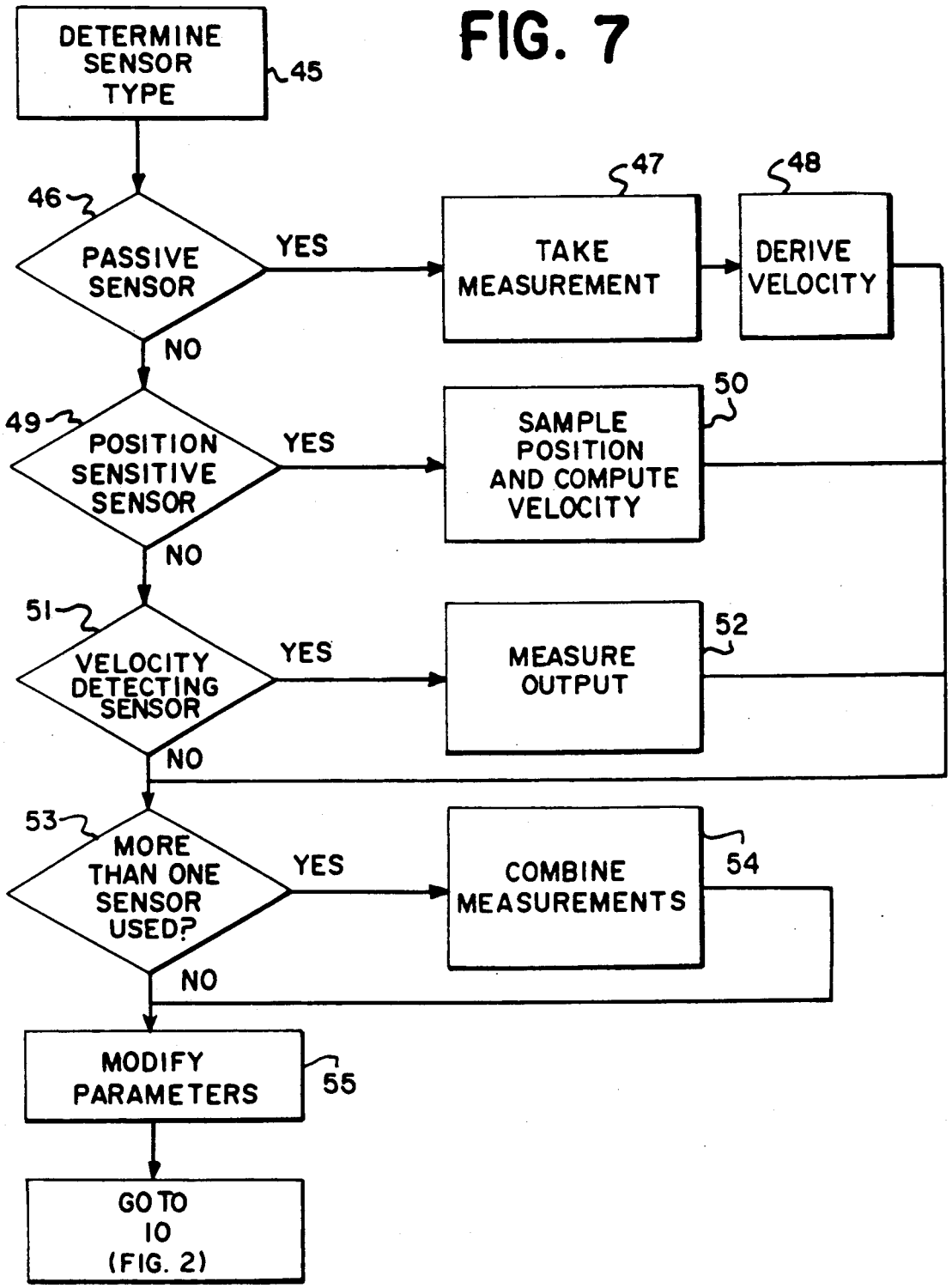
FIG. 7 is a block diagram which illustrates a technique whereby various different sensor types may be used to determine position relative to the EAS system.

However, this gives rise to a potential difficulty, that being the need to match the EAS system 1 of the present invention, and in particular the data processing steps performed within the processor 9, to the particular type of device which is used in a given application. An adaptive routine which can be used to accomplish this is illustrated in FIG. 7 of the drawings.

In conjunction with the acquisition of information performed in FIG. 2, at 10, steps are first taken to determine the type of sensor which is being utilized by the EAS system 1, at 45. To this end, a first test is made at 46 to determine whether the sensor which is used is a passive sensor, such as a photoelectric device or a basic heat sensor. Such sensors are only capable of quantitative measurements, and steps are therefore taken to perform the available measurement, at 47, and to then derive the object's velocity (i.e. rate of movement and whether approaching or departing from the EAS system), at 48, either as a time rate of change measurement, or by analyzing the output waveform, as previously described.

In the event that a passive sensor is not used, a test is then made at 49 to determine whether the sensor which is used is a position-sensitive sensor, such as an ultrasonic detector. If so, steps are then taken to sample the target's position at a given time, and to then compute velocity from this measurement, at 50.

In the event that a position-sensitive sensor is not used, a test is then performed at 51 to determine whether the sensor which is used is a velocity-detecting (i.e. motion) sensor, such as a doppler device or some of the more comprehensive ultrasonic and microwave devices which are available. If so, steps are then taken to measure the output of the device, at 52.

Irrespective of sensor type, following the indicated measurement steps are then taken to determine whether more than one type of sensor has been used, at 53. The use of more than one type of sensor can be used to optimize the information which is then developed, over any one particular type of sensor. If employed, the several readings taken from the sensors which have been used are then combined at 54, to yield a "most probable" velocity from an iteration of the signals received.

In any event, steps are then taken to modify various parameters used in performing the steps illustrated in FIG. 2 of the drawings, in accordance with the velocity measurements previously made, at 55. Such modifications may include variation of the delay established when latching the internal alarm, at 13, variation of the counts (system and background) which are performed at 11, and/or variation of the delay established when latching the auxiliary sensor 8, for the test 14. Information is then acquired, at 10, as previously described, making use of the modified parameters developed in accordance with the type of sensor in use.

It will therefore be understood that various changes in the details, materials and arrangement of parts which have been herein described and illustrated in order to explain the nature of this invention may be made by those skilled in the art within the principle and scope of the invention as expressed in the following claims.

What is claimed:

1. An apparatus for detecting tags or labels attached to protected articles, comprising:
   - means for producing an applied field in a selected region;
   - means for detecting disturbances in said applied field responsive to tags or labels passing through said region;
   - means for providing an alarm upon detecting said disturbances in said applied field;
   - sensor means for detecting a person passing through said region; and
   - means for enabling said alarm providing means only when said sensor means detects said person passing through said region;
   - wherein said field producing means and said disturbance detecting means operate substantially continuously, independent of the condition of said alarm providing means.

2. The apparatus of claim 1 wherein said applied field is a swept electromagnetic field and said tags or labels include resonant circuits for causing disturbances in said applied field.

3. The apparatus of claim 2 wherein said alarm providing means includes an external alarm for signaling a removal of one of said protected articles.

4. The apparatus of claim 1 wherein said sensor means is a proximity sensor.

5. The apparatus of claim 4 wherein said proximity sensor is selected from the group consisting of a photoelectric sensor, a body heat sensor, an ultrasonic sensor, a microwave sensor, an infrared sensor, and a pressure-sensitive switch.

6. The apparatus of claim 4 wherein said sensor means cooperates with said disturbance detecting means to selectively enable and disable said alarm providing means.

7. The apparatus of claim 4 wherein said sensor means determines only when a person is in said region.

8. The apparatus of claim 4 wherein said sensor means detects positions of said person relative to said region.

9. The apparatus of claim 4 wherein said sensor means is comprised of a plurality of sensors, and wherein said person is detected responsive to combined signals received from said plurality of sensors.

10. The apparatus of claim 4 wherein said disturbance detecting means is adjusted according to positioning of said person relative to said region.

11. The apparatus of claim 4 wherein said enabling means is adjusted according to positioning of said person relative to said region.

12. The apparatus of claim 1 wherein said enabling means includes means for acquiring data for determining when a tag or label is present in said selected region, means for determining when said person is present in said selected region, and means for enabling said alarm when said data acquiring means detects the presence of a tag or label in said region and said determining means detects the presence of a person in said region.

13. The apparatus of claim 12 wherein said data acquiring means operates periodically.

14. The apparatus of claim 12 wherein said enabling means further includes means for detecting disturbances in said applied field before detecting the presence of a person in said region.

15. The apparatus of claim 14 wherein said enabling means disables said alarm providing means when a disturbance is detected just prior to detecting the presence of said person in said region.

16. The apparatus of claim 15 wherein said enabling means includes a counter for detecting a number of disturbances prior to detecting the presence of said person in said region.

17. The apparatus of claim 16 wherein said enabling means disables said alarm providing means when said number exceeds a selected value.

18. The apparatus of claim 12 wherein said enabling means further includes means for adjusting parameters associated with said enabling means according to movements of said person within said selected region.

19. The apparatus of claim 18 wherein said adjusting means operates responsive to the speed of movement of said person within said selected region.

20. A method for detecting tags or labels attached to protected articles, comprising the steps of:
   - substantially continuously producing an applied field in a selected region;
   - substantially continuously detecting disturbances in said applied field responsive to tags or labels passing through said selected region;
   - providing an alarm upon detecting said disturbances in said applied field;
   - detecting persons passing through said selected region; and
   - enabling said alarm only when a person is detected passing through said selected region.

21. The method of claim 20 wherein said detecting of persons further includes detecting persons approaching said selected region.

22. The method of claim 21 wherein said detecting of disturbances is adjusted according to the approaching of said persons to said selected region.

23. The method of claim 21 wherein said enabling is adjusted according to the approaching of said persons to said selected region.

24. The method of claim 23 wherein said adjusting is responsive to the speed of movement of said person within said selected region.

25. The method of claim 20 wherein said enabling is responsive to the detecting of disturbances in said applied field in conjunction with the detecting of a person in said selected region.

26. The method of claim 25 which further comprises detecting disturbances in said applied field prior to detecting the person in said selected region.

27. The method of claim 26 which further comprises disabling said alarm when a disturbance is detected just prior to detecting the person in said selected region.

28. The method of claim 27 which further comprises counting the number of disturbances detected prior to detecting the person in said selected region.

29. The method of claim 28 which further comprises disabling said alarm when said number exceeds a selected value.

* * * * *